US007248170B2

(12) United States Patent
DeOme et al.

(10) Patent No.: US 7,248,170 B2
(45) Date of Patent: Jul. 24, 2007

(54) INTERACTIVE PERSONAL SECURITY SYSTEM

(76) Inventors: Dennis E. DeOme, c/o Robert Goulet, 285 Main St., Plaistow, NH (US) 03865; Lucy DeOme, c/o Robert Goulet, 285 Main St., Plaistow, NH (US) 03865

( * ) Notice: Subject to any disclaimer, the term of this patent is extended or adjusted under 35 U.S.C. 154(b) by 0 days.

(21) Appl. No.: 10/760,775

(22) Filed: Jan. 20, 2004

(65) Prior Publication Data

US 2004/0155781 A1 Aug. 12, 2004

Related U.S. Application Data

(60) Provisional application No. 60/441,680, filed on Feb. 22, 2003.

(51) Int. Cl.
*G08B 23/00* (2006.01)

(52) U.S. Cl. ..... 340/573.1; 340/573.2; 340/541; 463/1; 446/175

(58) Field of Classification Search ..... 340/573.1, 340/573.2, 539.11, 539.13, 539.15, 539.25, 340/541; 463/1, 39, 42; 434/169, 307 R, 434/308; 446/175

See application file for complete search history.

(56) References Cited

U.S. PATENT DOCUMENTS

| | | | | |
|---|---|---|---|---|
| 4,650,219 | A | 3/1987 | Sigman | 283/70 |
| 4,675,519 | A * | 6/1987 | Price | 446/175 |
| 4,675,656 | A | 6/1987 | Narcisse | 340/539 |
| 4,888,580 | A | 12/1989 | Distel | 340/573 |
| 4,904,988 | A | 2/1990 | Nesbit et al. | 340/628 |
| 4,918,425 | A | 4/1990 | Greenberg et al. | 340/539 |
| 4,931,913 | A | 6/1990 | Hwang | 362/103 |
| 5,119,072 | A | 6/1992 | Hemingway | 340/573 |
| 5,289,163 | A | 2/1994 | Perez et al. | 340/539 |
| 5,454,600 | A | 10/1995 | Floyd | 283/78 |
| 5,457,440 | A | 10/1995 | Daddono | 340/573 |
| 5,485,163 | A | 1/1996 | Singer et al. | 342/457 |
| 5,512,879 | A | 4/1996 | Stokes | 340/573.4 |
| 5,629,678 | A | 5/1997 | Gargano et al. | 340/573 |
| 5,636,994 | A * | 6/1997 | Tong | 434/308 |
| 5,746,602 | A * | 5/1998 | Kikinis | 434/169 |

(Continued)

OTHER PUBLICATIONS

U.S. Appl. No. 60/441,680, filed Jan. 22, 2003. Title: Interactive Personal Security System. Applicant: Dennis E. DeOme.

*Primary Examiner*—Van T. Trieu
(74) *Attorney, Agent, or Firm*—Burns & Levinson LLP; Orlando Lopez

(57) ABSTRACT

An interactive personal security system utilizing a portable object having embedded therein all or a combination of a microphone, still and video cameras, distance sensor, a timer, speakers, a motion sensor, a tracking transponder, a receiver, and a transmitter operably connected to a power source and a conventional microprocessor including input devices, random access memory, read only memory and a database. Sounds and images are transmitted to remote monitoring stations by radio waves or microwaves for radio or television broadcasting or recording on a tape recorder or VCR. Alarms are transmitted to telephones and beepers. Face and voice recognition software identifies the people speaking, playing or attempting to kidnap the child. Sensors identify the presence of persons or animals or a child wandering out of a restricted area. Speakers allow guardians to communicate two-ways with the child, thereby responding to the immediate needs of the child. Tracking transponder allows for a pinpoint location of the portable object.

34 Claims, 8 Drawing Sheets

U.S. PATENT DOCUMENTS 5,752,880 A * 5/1998 Gabai et al. ..... 463/1
5,842,900 A 12/1998 Hodge ..... 446/73
5,973,591 A 10/1999 Schwartz et al. ..... 340/384.7
5,983,186 A 11/1999 Miyazawa et al. ..... 704/275
6,022,273 A * 2/2000 Gabai et al. ..... 463/39
6,089,942 A * 7/2000 Chan ..... 446/175
6,160,986 A * 12/2000 Gabai et al. ..... 434/308
6,264,521 B1 7/2001 Hernandez ..... 446/73
6,310,539 B1 10/2001 Rye et al. ..... 340/321
6,337,552 B1 * 1/2002 Inoue et al. ..... 318/568.2
6,352,478 B1 * 3/2002 Gabai et al. ..... 463/42
6,733,344 B2 * 5/2004 Quardt et al. ..... 439/716
6,763,282 B2 * 7/2004 Glenn et al. ..... 700/245
6,889,135 B2 * 5/2005 Curatolo et al. ..... 701/207
6,959,166 B1 * 10/2005 Gabai et al. ..... 434/308

* cited by examiner

INTERACTIVE PERSONAL SECURITY SYSTEM

CROSS REFERENCE TO RELATED APPLICATIONS

This application claims benefit of U.S. Provisional Application 60/441,680, filed on Jan. 22, 2003, which is incorporated by reference herein.

BACKGROUND OF THE INVENTION

This invention relates to an interactive personal security system and in particular to a child's portable companion to aid in the prevention of child abduction and abuse.

Children are abducted daily in our society by strangers, family and friends. Police response frequently occurs hours after such abduction. In many cases the children are harmed and in some cases they are killed. There are child-tracking devices commercially available which are capable of monitoring the location of the missing child but there are no known commercially available devices that monitor the children's' activities and surroundings that may indicate danger is imminent. These commercially available devices cannot monitor the movements of a person with the intent to abduct or harm a child as the person approaches the child. Further, these devices cannot warn the child to run away and seek safety.

It is an object of this invention to provide a compact, economical children's play toy with security features that protect children within or outside of the home.

It is a further object of this invention to provide a device that records images and sounds of the child and the child's surroundings.

It is a further object of this invention to provide a tracking device to locate a missing child.

It is another object of this invention to provide a device to identify and locate the people their children meet and or associate with.

It is another object of this invention to provide an educational device to teach a child what to do in difficult situations.

It is a further object of this invention to provide a device with child identification cards and guardian information.

Still further objects and advantages will become apparent from a consideration of the ensuing description and accompanying drawings.

SUMMARY OF THE INVENTION

The objects set forth above as well as further and other objects and advantages of the present invention are achieved by the embodiments of the invention described herein below.

The preferred embodiment introduces a plurality of electronic devices attached to and/or embedded within a conventional child's toy or the like. The toy may be in the form of an animal, a person, or an inanimate object such as a vehicle. For example, a stuffed bear or any stuffed toy of any kind or size can be used. In certain cases the figure includes of a head having eyes, ears, and mouth.

In this invention, one or more monitoring components monitor the environment exterior to the toy (or other object) and are operably connected with the toy (or other object). The one or more monitoring components provide output with respect to the environment exterior to the toy (or other object). One or more processing components are operably connected to the one or more monitoring components. The one or more processing components are capable of processing the output from the one or more monitoring components in order to provide a signal in response thereto. One or more signal generating components are operably connected to the one or more processing components. The one or more signal generating components are capable of receiving processed output from the one or more processing components and generating a warning indicative of the environment exterior to the object.

The present invention can utilize a microphone, still and video cameras, sensors, a timer, speakers, a motion detector, a distance sensor, a tracking transponder, a receiver, and a transmitter operably connected to a power source and a conventional microprocessor including input devices, random access memory, read only memory and a database.

The present invention can record and photograph the events occurring around the child. Parents can monitor a child as he/she plays or sleeps. Microprocessors that record and photograph who the child is with and where they are playing. Face recognition software identifies the people speaking, playing or attempting to kidnap the child. The sounds and images are transmitted to remote monitoring stations by radio or microwave (satellite) for radio or television broadcasting or recording on a tape recorder or VCR. Guardians can take immediate action to warn the child of potential danger or to contact law enforcement agencies to intervene.

The present invention provides guardians with the capability to broadcast instructions to child from the monitoring station. The guardians can transmit an audio signal from the remote station to the receiver embedded in the toy. The receiver conveys the audio message to the embedded speaker such that the guardian can instruction the child to come home for dinner or to run away from the stranger.

The present invention can include prerecorded audio answers to child's frequently asked questions asked. The audio response can be that of the mother or the father. The present invention includes voice recognition software to respond only to a specific child's voice. The microprocessor stores in a database a list of preprogrammed questions and responses. The guardian can modify the list at any time. Voice recognition software can activate all the electronic devices when the child screams in fear transmitting emergency distress signals to all monitors.

Police or other monitoring stations can also receive transmitted messages. The transmission can be in the form of an alarm or a beeper message providing the location of the child.

The present invention with distance sensors can be programmed to notify parents if the child is out of the house.

Additionally, the present invention has a containment pouch, fanny pack or likes to hold a certificate with the child's name, picture, description, fingerprints and I.D. number. The certificate includes the address and telephone number of each parent. The certification can include a picture of the mother and/or father, a right thumbprint, physical descriptions, social security numbers, legal names and mother's maiden name, if married. The certification can also include a family picture. The pictures can be updated every year. The duplicate information can on file at the police station and/or private monitoring company.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

Figure 1:
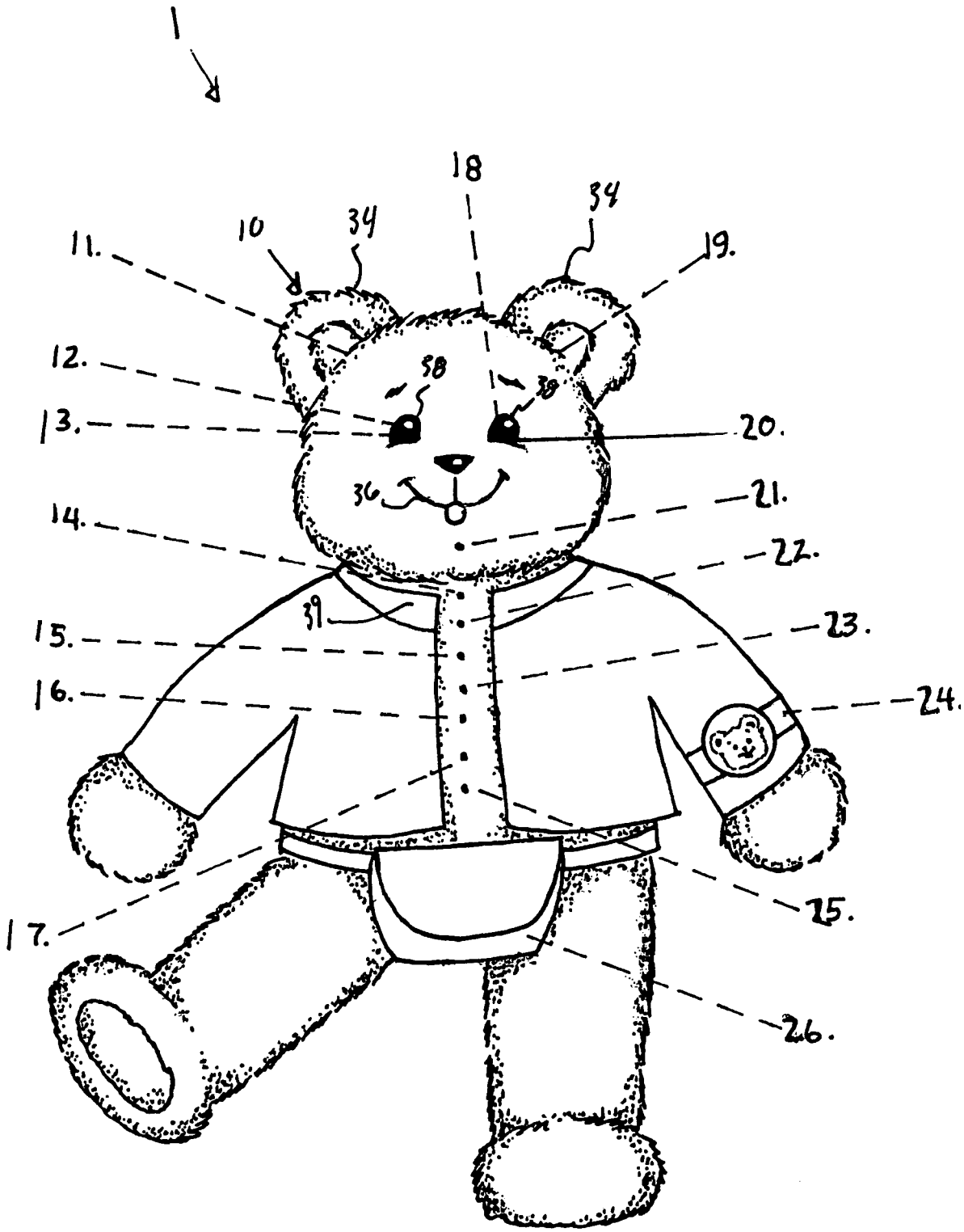
FIG. 1 is a pictorial representation of the an embodiment of the system of this invention.

FIG. 1 illustrates an embodiment 1 of the warning system of the present invention. As therein shown, conventional components such as, but not limited to, microphones 11, 19, a camera 12, an infrared still camera 13, a distance sensor 14, a voice recognition microprocessor 15, a face recognition microprocessor 16, a timer 17, a video camera 18, a speaker 20, a motion detector 21, a tracking transponder 22, a receiver 23, a detachable watch 24, a panic button 25, and a containment pouch 26 are incorporated, for example, into a soft or stuffed toy 10.

Figure 2:
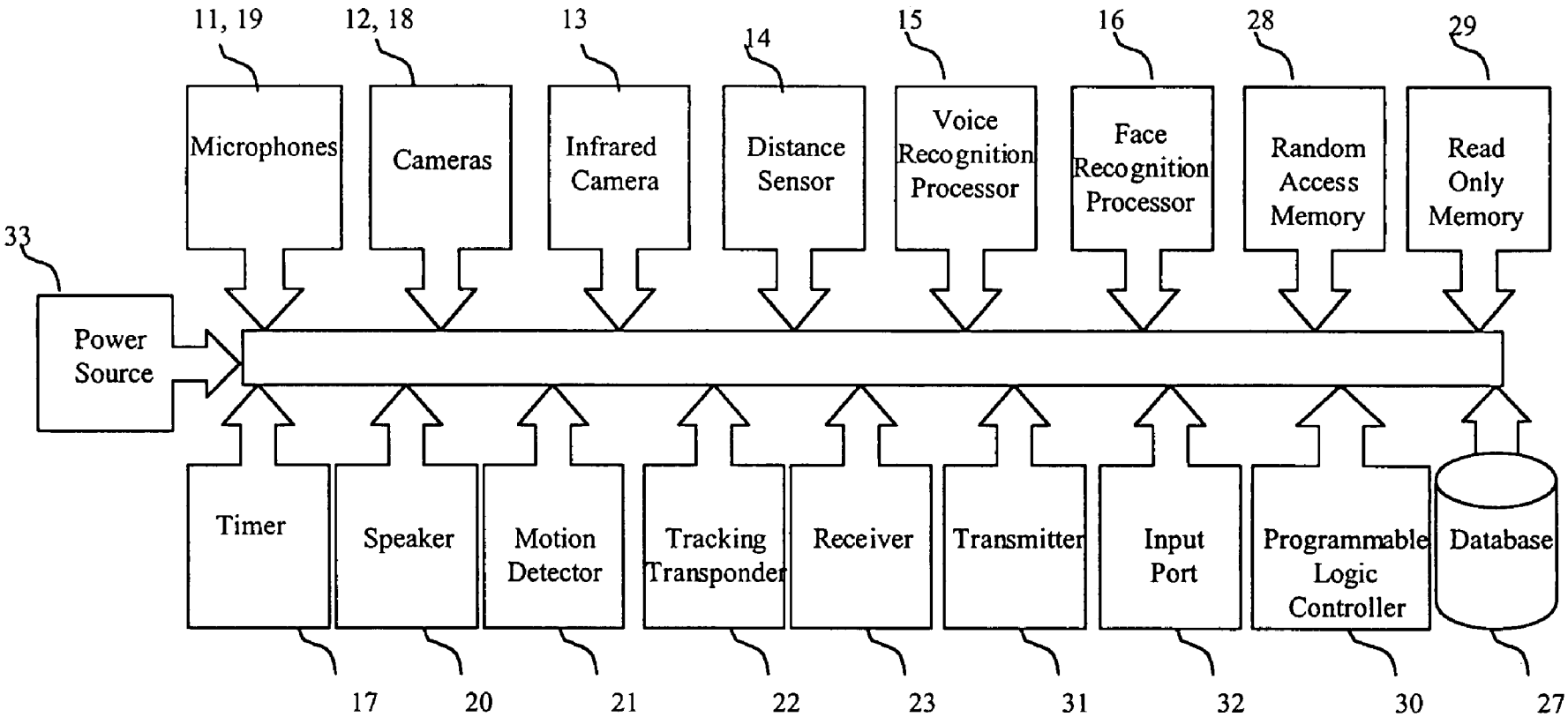
FIG. 2 is a schematic representation of the electronic components of the embodiment illustrated in FIG. 1.

FIG. 2 illustrates the above mentioned electronic components in schematic/block form along with data processing devices including a database 27, random access memory 28, read only memory 29, input port 32 operably connected to a programmable logic controller 30 (also referred to as a control processor). Additionally, a transmitter 31 is operably connected to the programmable logic controller 30 to generate alarms, messages, and information to the monitoring stations. All electrical components are powered by a power source 33, such as a battery. The input port 32 is compatible with conventional data transfer devices such as a personal data assistant and other personal computers to download data and programs. The timer 17 is capable of activating the above-mentioned electronic devices automatically to record sounds and/or images or to give instructions (to be discussed in detail below).

Figure 3:
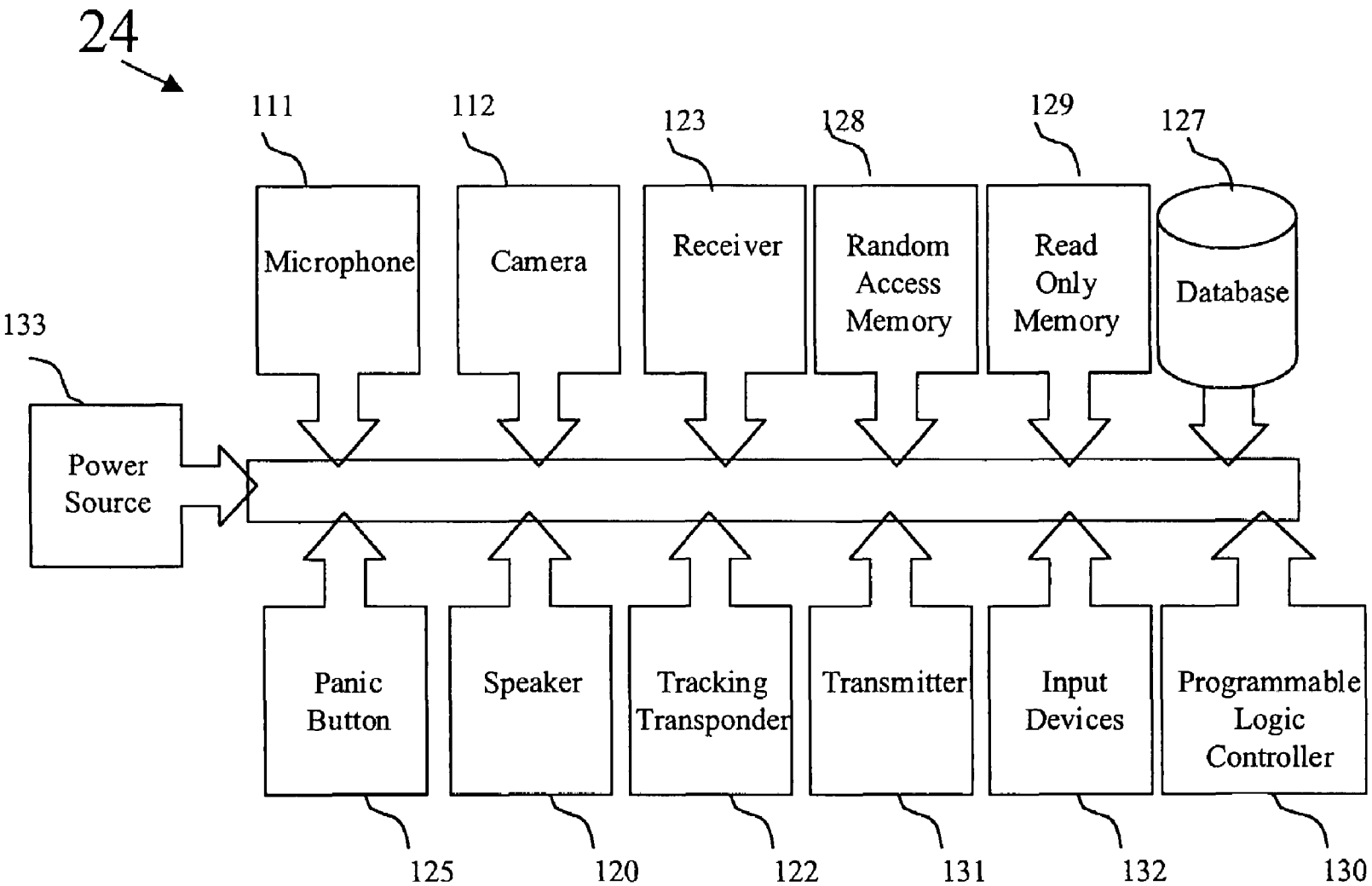
FIG. 3 is a schematic representation of the electronic components of an embodiment of a detachable object of this invention.

Detachable watch 24 is a separate system capable of performing most of the same functions as the stuffed toy but with the added feature of being capable of attachment directly to the child. FIG. 3 illustrates an example of the electronic components of the detachable watch 14, such as a microphone 111, a camera 112, a speaker 120, a tracking transducer 122, a receiver 123, a panic button 125, a database 127, a random access memory 128, a read only memory 129, a programmable logic controller 130, a transmitter 131, an input port 123, and a power source 133. It should be understood that the detached watch 24 is only an embodiment of a removable article that can be worn by the child as well as be attached to the stuffed toy 10. Other articles, such as a bracelet or pin, are also possible embodiments of the removable article (object).

Figure 4:
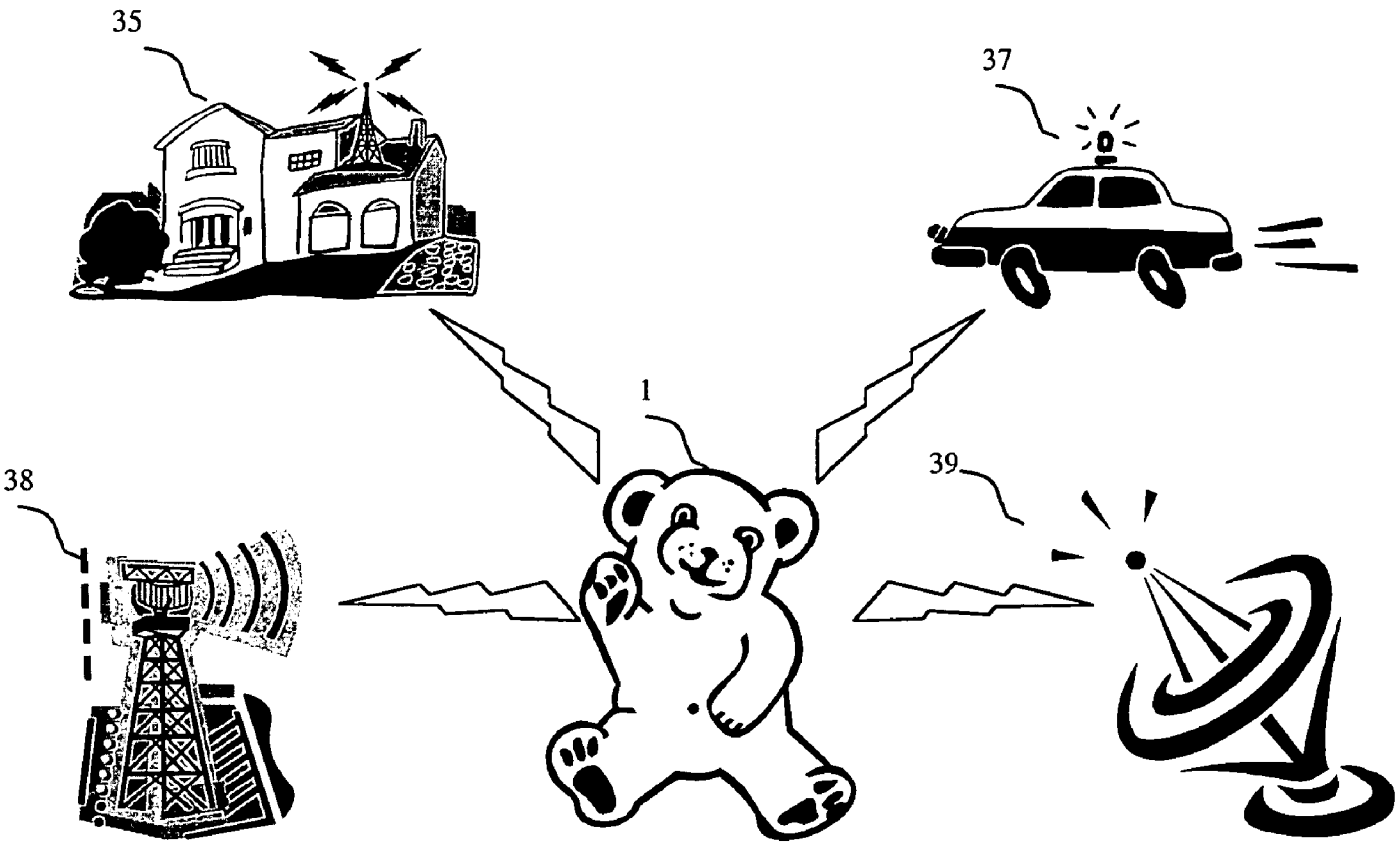
FIG. 4 is a schematic representation of the present invention illustrated in FIG. 1 transmitting a signal to a network of monitoring stations.
Figure 5:
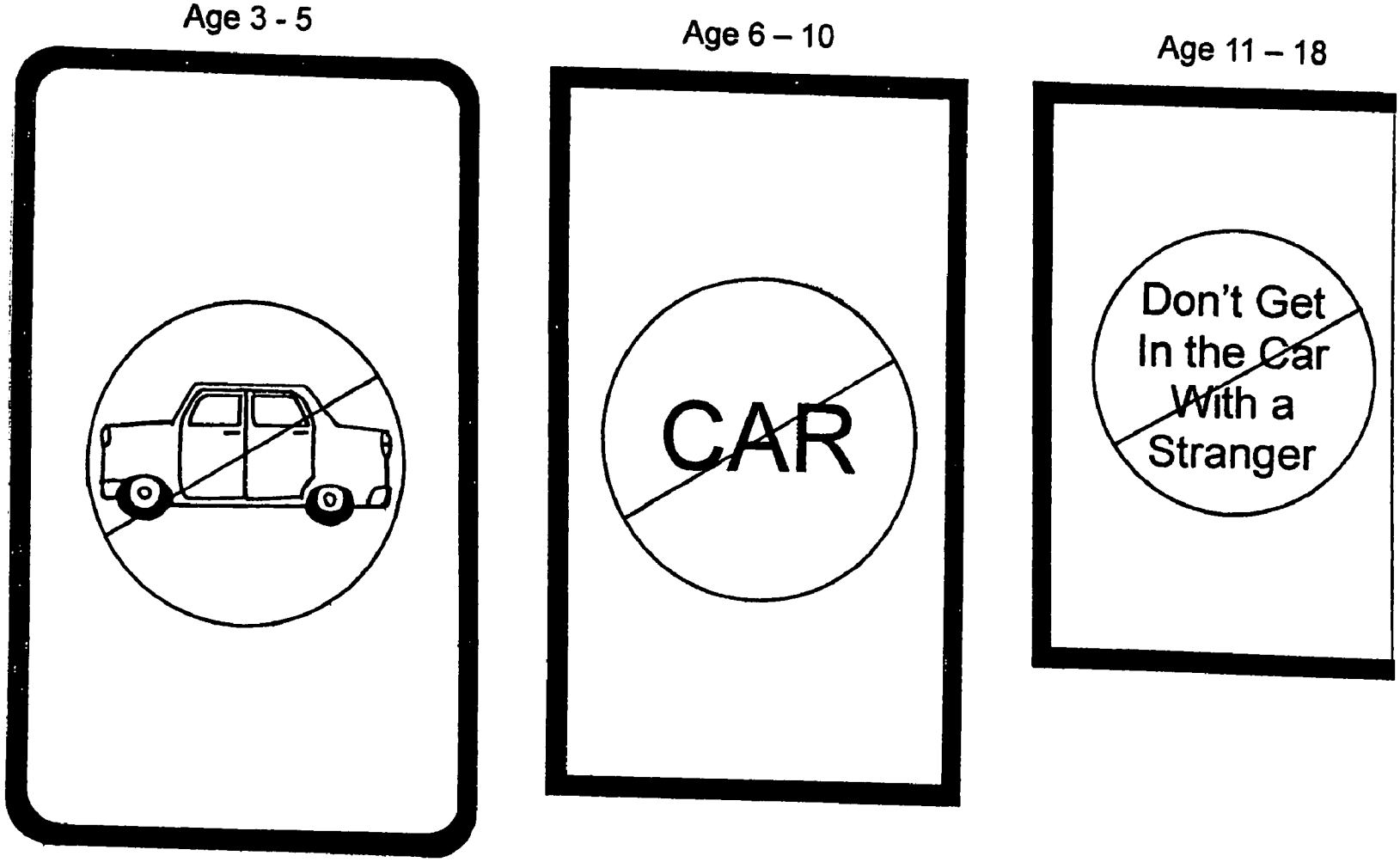
FIG. 5 is a pictorial representation of instructional flash cards of the present invention.
Figure 6:
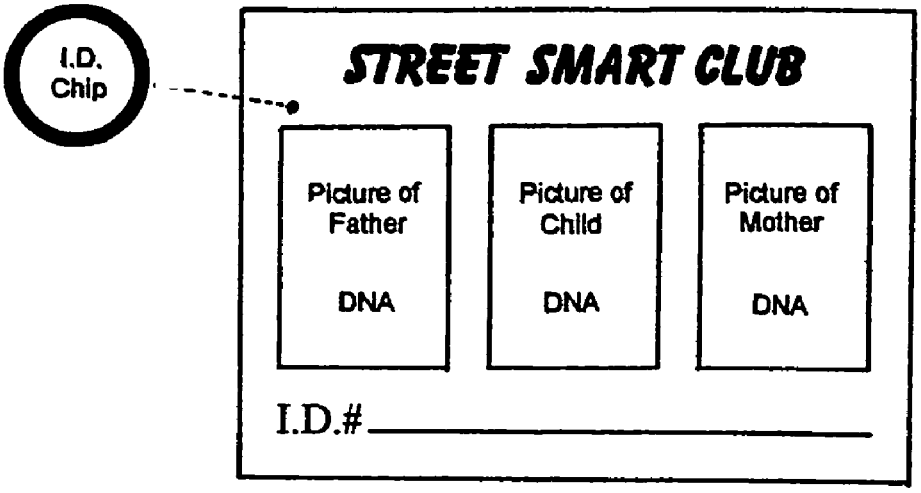
FIGS. 6–8 are pictorial representations of identification cards of the present invention.
Figure 6:
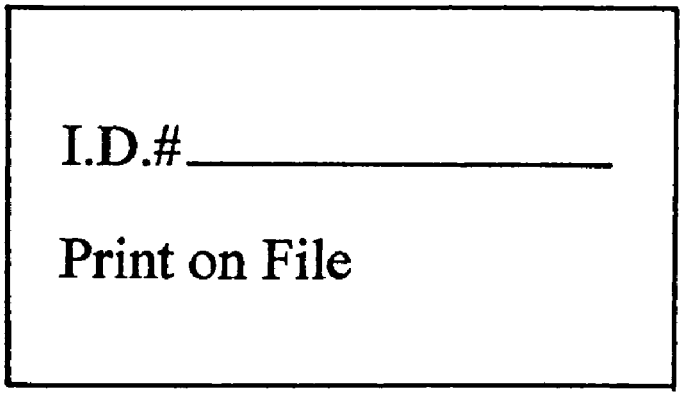
Figure 6:
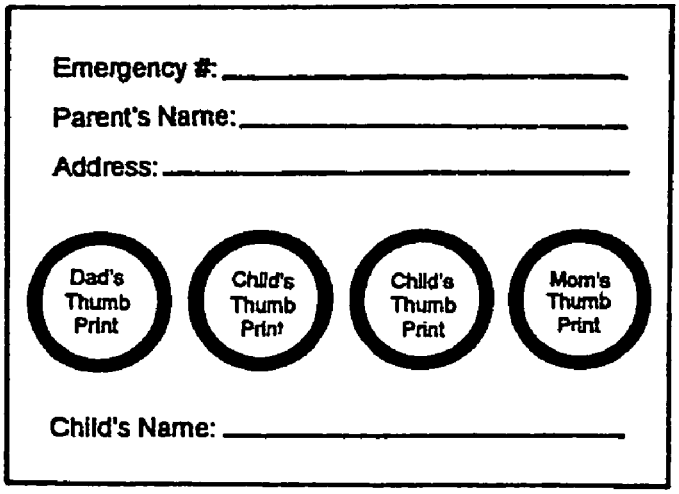
Figure 7:
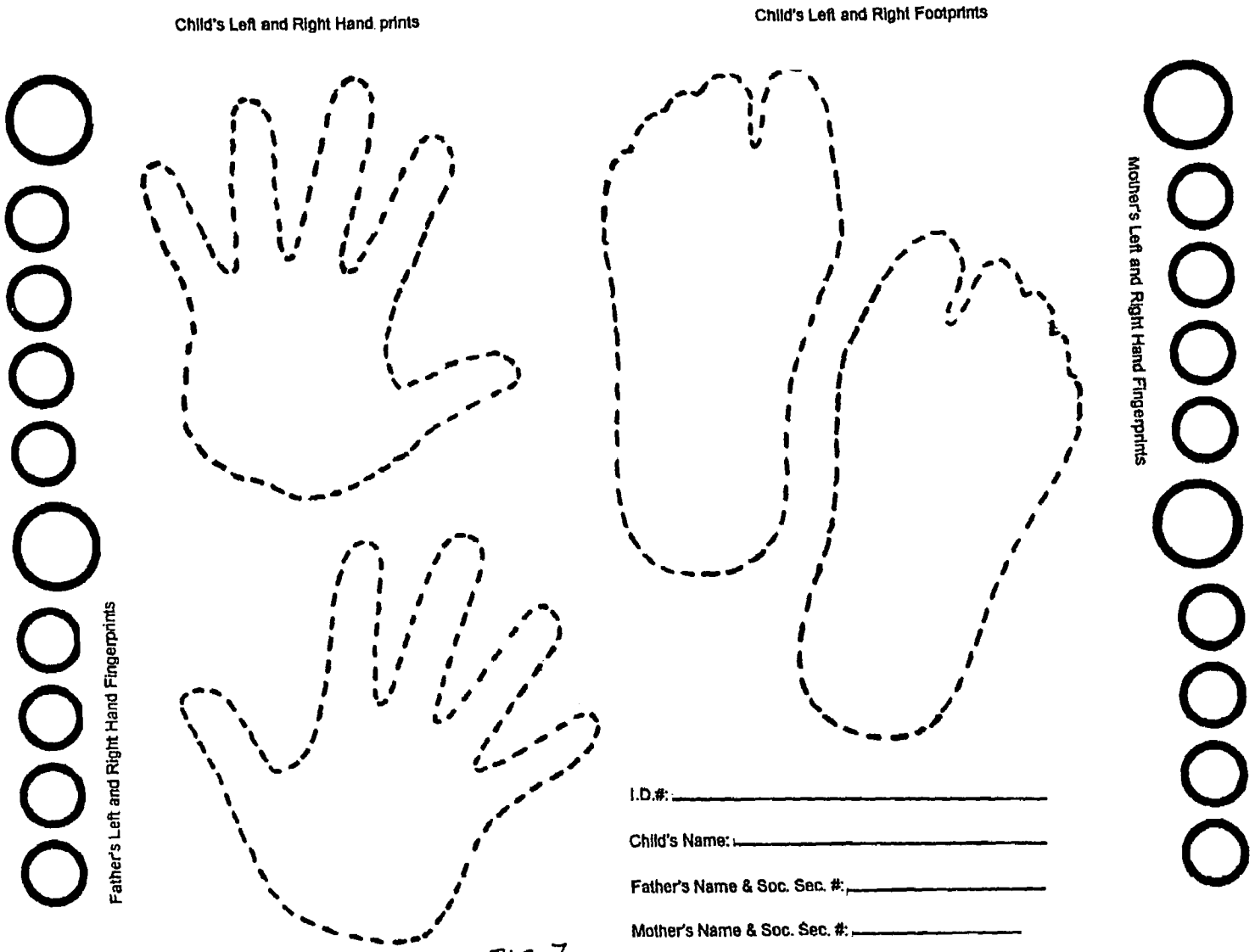
Figure 8:
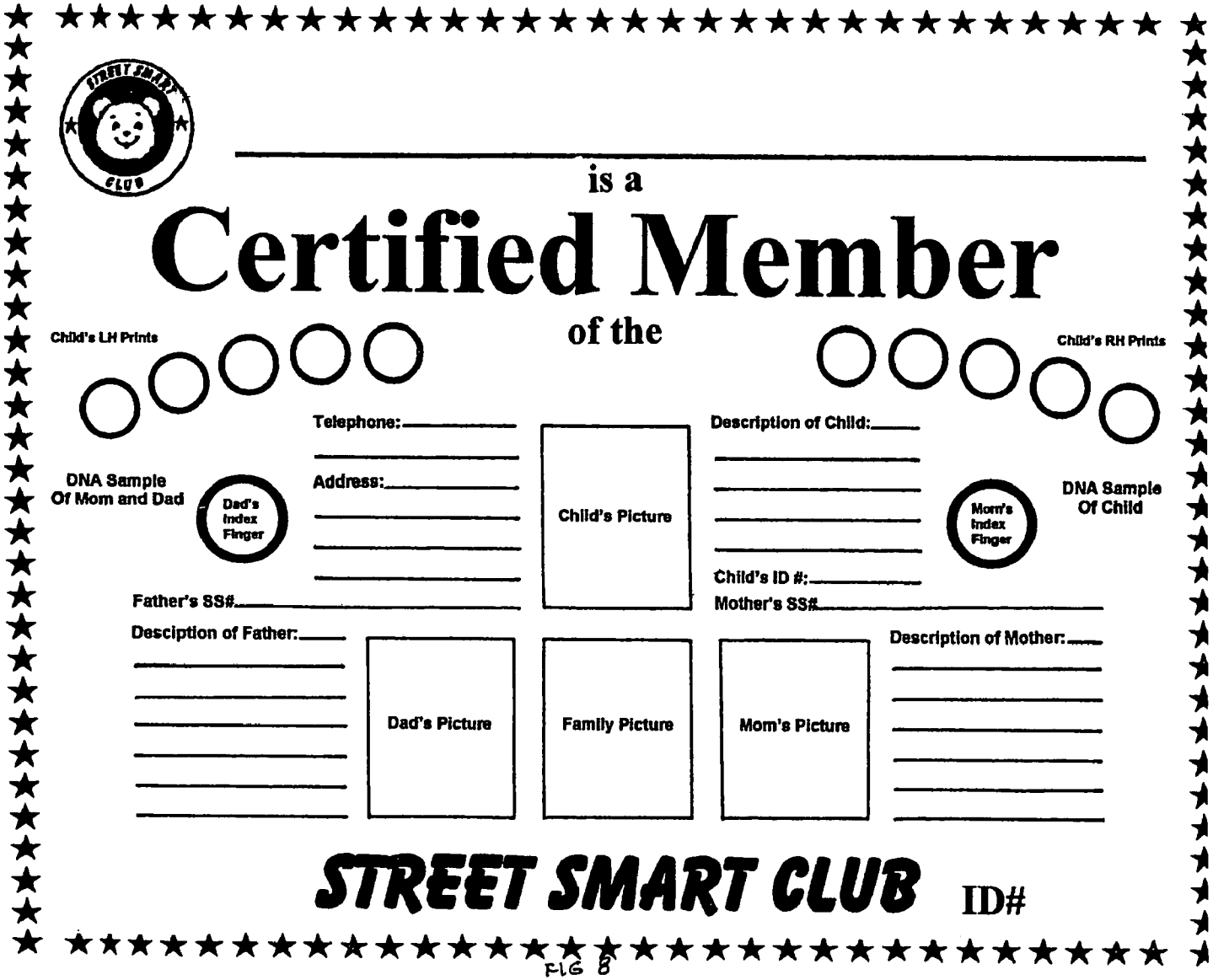

The attachment location of each of the components listed above onto or into the stuffed toy 10 is arbitrary. For illustration purposes, certain components are located in positions commensurate with their function. As illustrated in FIG. 1, the ears 34, for example, contain commercially available microphone 11 that provides audio feedback of what the child is saying and what is being said to the child. The transmitter 31, FIG. 2, generates a signal of the audio feedback to the monitoring station 35 for evaluation and, if desired, recording, as illustrated in FIG. 4. The transmitter 31 can be a radio transmitter, microwave transmitter, infrared transmitter, or any known or unknown communication medium. The system monitor has the capability to talk to the child through a speaker 20 the when child asks a question, such as "Should I talk to a stranger?" The monitor's response is transmitted from the monitoring station 35, FIG. 4, to receiver 23, FIG. 1, and converted to a signal by the programmable logic controller 30 and converted into an audible message by the speaker 20 for the child to hear. The speaker 20 can be positioned behind the mouth 36, such that, the stuff toy can answer or give instruction when the child asks a question. Additionally, a signal can be generated for receipt by law enforcement authorities 37, cellular communications 38, and satellite communications 39. The cellular and satellite communications can relay the signal to mobile telephones and beeper.

Alternatively, a preprogrammed response can be stored in the database 27 to response to the child's question based on key phrases or terms. The programmable logic controller 30 searches the database 27 to match a preprogrammed response with a key phrase or term to give the child an answer to what to do in that particular situation. Several questions and answers can be programmed into the programmable logic controller 30. The preprogrammed responses will assist the child in making the right decision in a bad situation. In operation, the child will asked a question in the vicinity of the microphone 11 positioned in, for example, one of the ears 34 of the stuffed toy 10. The audio response will be projected from the speaker 20 positioned, for example, in the mouth 36 of the stuff toy 10. The programmable logic controller 20 can execute a voice stress measurement algorithm to determine whether the child is under distress and block or delay the audio message until the child is no longer under stress.

The present invention can include one or more cameras 12, 13, 18 to aid the system monitor in observing the surrounding of the child and, in particular, the person, persons or animals in the immediate vicinity. The cameras, for example, can be located in one or more eye sockets 38 of the stuffed toy 10. The system monitor can remotely operate the cameras 12, 13, 18 can be controlled by the timer 17 for taking single or multiple frames. The camera 12 captures still images during the normal daylight hours. The infrared camera 13 is utilized when the natural lumination is inadequate for clear, identifiable images. A video camera 18 is utilized when the precise movement of a subject is required or when the time delay between the still shot frames are not sufficient.

The present invention can include a distance sensor 14 located, for example, inside the chest 39 and or an item of apparel of the toy. A set distance guardian can be programmed such that the child is only allowed to move within a confined area. An audio alarm is sounded through a speaker 20 and a signal can be transmitted to the system monitor. The signal can be transmitted to a beeper or a computer system or a telephone alerting the guardian or system monitor that the child has voluntarily or involuntarily left the designated area.

The present invention can include a voice recognition microprocessor 15 to identify the voice of a person or persons in the vicinity of the child. The voice recognition microprocessor 15 is capable of generating a voice pattern and comparing the voice pattern to stored voice patterns.

The collection of stored voice patterns can be updated periodically by downloads by interfacing with the databases of law enforcement agencies or special interest organizations, which collect data on child molesters and other violent crime perpetrators. Data can be downloaded remotely through the receiver 23 (wireless) or locally through the input port 32 (wired) in response to a command from the programmable logic controller 30. Further, the voice recognition microprocessor 15 can generate a signal to the programmable logic controller 30 to block or delay the audio response to a question asked by a person other than the child.

The present invention can also include a face recognition microprocessor 16 to identify the face of a person or persons in the vicinity of the child. The face recognition microprocessor 16 is capable of generating a digital image of the face and compares the image to stored digital facial images. The collection of stored digital facial images can be updated periodically by downloads by interfacing with to the databases of law enforcement agencies or special interest organizations, which collect data on child molesters and other violent crime perpetrators. Data can be downloaded remotely through the receiver 23 (wireless) or locally through the input port 32 (wired) in response to a command from the programmable logic controller 30.

A motion detector 21 can be positioned, for example, at the lower head area to activate the recording of sounds and/or images when there is movement within a predetermined area of the stuffed toy 10. The motion detector 21 can be placed, for example, in the bedroom of the child during nap times and/or bedtime. During its active mode, a signal transmits sounds and/or images to the monitoring station, telephone, and/or beeper when there is a disturbance in the air current or when there is an increase in room temperature indicating the presence of a person or animal. The motion detector 21 can be programmed for a predetermined radius and sensitivity. However, the motion detector 21 can be deactivated when the stuffed toy 10 is to be place in a known active area to avoid false alarms.

The present invention can also include a tracking transponder 22 imbedded, for example, in the chest 39 of the stuffed toy 10. The tracking transponder 22 is capable of generating a signal either at a predetermined interval continuously or when activated remotely by the guardian. In the case of abduction, the location of the child can be tracked for prompt recovery of the child before child is harmed further. In one embodiment, but not limited to, the tracking transponder is a GPS system.

The panic button 25 is a conventional switch operably connected to the programmable logic controller 30, which causes the programmable logic controller 30 to generate a series of commands in response to a signal of the panic button 25. The programmable logic controller 30 is capable of generating an audible signal of sufficient volume to the speaker 20 to create alert passersby and to scare away the attacker. the Additionally, the programmable logic controller 30 is capable of generating a signal to the transmitter 31 that broadcasts one or more signals to telephones, beeper, or computer monitoring systems (FIG. 4).

A further embodiment of the present invention is responsive to a certain word, phrase, name, or telephone number spoken by the child. The programmable logic controller 30 includes voice recognition software responsive to the voice pattern of the child. Similar to the panic button 25, the programmable logic controller 30, operably connected to the microphone 11, is capable of generating a signal via the transmitter 31 to a monitoring station, a telephone, and/or a beeper to alert guardians of a potential problem.

A further embodiment of the present invention includes a containment pouch 26 containing information about the child, guardians, and instructional information for the child. The pouch 26 can include an information bearing component such as, but not limited to, information flash cards, pamphlets with safety tips, identification cards, hidden mini waterproof certificate identification, and medical and dental information of the guardians as well as the child. Examples of the information are illustrated in FIGS. 5–8 and can be in Braille as well as printed in any language. The cards, for example 12 in. by 10 in. or 2 in. by 3 in., include the child's name, picture, fingerprints, palm prints, footprints, description and date of birth, identification number, and DNA signature. The same information is included for the guardians. Additionally, a tracking transponder can be embedded into one or more of the identification cards to locate the child. A further security feature is to print certain information that can only be seen under infrared light.

It should be understood that any combination of the above-mentioned embodiments is within the scope of the present invention and placed in any object and the audio communication can be in any language. For example, the tracking transponder and panic button features can be placed into a piece of jewelry, such as a bracelet or necklace. A manual or voice activated panic button can sound an alarm and activate the tracking device. Voice activation can be customized to respond to a certain word or phrase related to certain crimes, such as rape, assault, robbery, murder, and kidnapping.

It should be noted that the programmable logic controller 30 could, in some embodiments, also be a processor and could be combined with other microprocessors in different embodiments. It should also be noted that input port 32 can include, but is not limited to, conventional interface connections, supporting electronics and software for interfaces such as, but not limited to, USB, RS-232, for example. It should further be noted that database 27 could be, in some embodiments, a remote database accessed by a wireless link such as that implemented by transmitter 31 or could be a combination of a local database and a remote database.

Although the invention has been described with respect to various embodiments, it should be realized this invention is also capable of a wide variety of further and other embodiments within the spirit and scope of the appended claims.

What is claimed is:

1. A child personal security system comprising:

an object;

at least one monitoring component capable of monitoring the environment exterior to said object and providing output with respect thereto, said at least one monitoring component operably connected with said object;

at least one processing component operably connected to said at least one monitoring component, said at least one processing component capable of processing said output in order to provide a signal in response thereto;

at least one signal generating component operably connected to said at least one processing component, said at least one signal generating component capable of receiving processed output from said at least one processing component and providing a signal to a remote location, said signal derived from the received processed output;

at least one receiving component operably connected to said at least one processing component, said at least one receiving component capable of receiving another signal from the remote location, said another signal being derived from a comparison of said signal and data is stored at the remote location; and means for generating, from said another signal, a warning indicative of the environment exterior to said object.

2. The child personal security system of claim 1 further comprising:

a detachable object.

3. The child personal security system of claim 2 wherein said detachable object comprises:

at least one monitoring component capable of monitoring the environment exterior to said detachable object;

at least one other processing component; and, at least one other signal generating component.

4. The child personal security system of claim 2 wherein said detachable object comprises a wrist watch.

5. The child personal security system of claim 1 wherein said at least one processing component further comprises:

at least one processor; and at least one computer readable memory.

6. The child personal security system of claim 5 wherein said at least one processor comprises a face recognition processor.

7. The child personal security system of claim 5 wherein said at least one processor comprises a speech recognition processor.

8. The child personal security system of claim 5 wherein said at least one processor comprises a control processor.

9. The child personal security system of claim 1 wherein said at least one processing component further comprises:

a database.

10. The child personal security system of claim 1 wherein said at least one processing component further comprises:

an input port.

11. The child personal security system of claim 1 wherein said at least one processing component further comprises:

an input receiving component capable of receiving external inputs;

the external inputs being capable of causing said at least one processing component to generate response signals.

12. The child personal security system of claim 9 wherein said database includes a response corresponding to a pre-selected output from said at least one monitoring component.

13. The child personal security system of claim 12 wherein said at least one signal generating component comprises a speaker;

wherein said response corresponding to the pre-selected output comprises data corresponding to a pre-selected speaker signal.

14. The child personal security system of claim 1 wherein said at least one monitoring component comprises a distance measuring component.

15. The child personal security system of claim 1 wherein said at least one monitoring component comprises at least one camera.

16. The child personal security system of claim 1 wherein said at least one monitoring component comprises a motion detector.

17. The child personal security system of claim 1 wherein said at least one monitoring component comprises a microphone.

18. The child personal security system of claim 1 wherein said at least one signal generating component comprises a transmitter.

19. The child personal security system of claim 1 wherein said at least one monitoring component comprises a tracking transponder.

20. The child personal security system of claim 1 wherein said at least one monitoring component comprises a UPS system.

21. The child personal security system of claim 1 wherein said object comprises a toy.

22. The child personal security system of claim 1 further comprising an information bearing component.

23. The child personal security system of claim 22 wherein said information bearing component comprises instructional information.

24. The child personal security system of claim 22 wherein said information bearing component comprises identifying information.

25. A method for enhancing personal security of children, the method comprising the steps of:

providing an object;

monitoring environment exterior to said object;

processing signals generated by monitoring devices operable connected with said object;

providing the processed signals to a remote location;

generating at the remote location a signal indicative of a comparison of the processed signals and data stored at the remote location; and, generating warning signals from the comparison of the processed signals and data stored at the remote location.

26. The method of claim 25 further comprising the step of receiving an external input signal.

27. The method of claim 25 wherein the step of monitoring the environment further comprises the step of obtaining image information.

28. The method of claim 25 wherein the step of monitoring the environment further comprises the step of obtaining audio information.

29. The method of claim 25 wherein the step of monitoring the environment further comprises the step of obtaining position information.

30. The method of claim 25 wherein the step of monitoring the environment further comprises the step of obtaining location information.

31. The method of claim 25 wherein the step of generating warning signals further comprises the step of generating an audio signal.

32. The method of claim 25 wherein the step of generating warning signals further comprises the step of transmitting a signal.

33. The method of claim 25 further comprising the step of providing an information bearing component.

34. The method of claim 25 further comprising the step of:

providing a detachable object.

* * * * *

UNITED STATES PATENT AND TRADEMARK OFFICE

CERTIFICATE OF CORRECTION

PATENT NO. : 7,248,170 B2
APPLICATION NO. : 10/760775
DATED : July 24, 2007
INVENTOR(S) : Dennis E. DeOme et al.

It is certified that error appears in the above-identified patent and that said Letters Patent is hereby corrected as shown below:

On the title page, under Related U.S. Application Data (60), "Feb. 22, 2003" should read -- Jan. 22, 2003 --

In column 8, line 8, "UPS" should read -- GPS --

Signed and Sealed this

Fourth Day of September, 2007

JON W. DUDAS
*Director of the United States Patent and Trademark Office*